US005655768A

United States Patent [19]

Moret et al.

[11] Patent Number: 5,655,768

[45] Date of Patent: Aug. 12, 1997

[54] BOWLING TOY

[76] Inventors: Roger P. Moret, 127 Naglee St., San Francisco, Calif. 94112; Kenneth A. Tarlow, 94 Birch Ave., Corte Madera, Calif. 94925; Cristino V. Alegria, 275 Parker Ave. #204, San Francisco, Calif. 94118

[21] Appl. No.: 683,810

[22] Filed: Jul. 16, 1996

[51] Int. Cl.[6] ..... A63D 3/00; A63D 3/02

[52] U.S. Cl. ..... 273/108.5; 273/118 A; 273/129 S; 473/116; 473/85

[58] Field of Search ..... 473/73, 85, 115, 473/116, 117; 273/129 S, 129 T, 108.5, 108.1, 317.1, 119 R, 118 A, 126 R, 126 A, 127 A, 128 R, 108.57, 108.31

[56] References Cited

U.S. PATENT DOCUMENTS

| | | | |
|---|---|---|---|
| 985,561 | 2/1911 | Wehner | 473/116 |
| 1,203,805 | 11/1916 | Stephan | 473/116 |
| 1,405,967 | 2/1922 | Cawley | 473/116 |
| 2,719,040 | 9/1955 | Fischer | 273/129 S |
| 2,760,776 | 8/1956 | Tullio | 273/129 S |
| 3,009,452 | 11/1961 | Barber | 273/129 S |

FOREIGN PATENT DOCUMENTS

| | | | |
|---|---|---|---|
| 764364 | 5/1934 | France | 273/129 S |
| 766004 | 6/1934 | France | 273/129 S |
| 882366 | 7/1953 | Germany | 473/116 |

OTHER PUBLICATIONS

Advertisement For "Kenner's Jet–Shoot Games", Kenner Products Co, 1966 Catalog, Received Mar. 10 1966.

*Primary Examiner*—Sebastiano Passaniti

[57] ABSTRACT

A bowling toy having a unique ball launching and pin setting means. The miniature bowling ball is placed in a tubular launcher where both gravity and a motorized spinning rubber wheel act to propel the ball down a miniature bowling alley. The rubber wheel can be adjusted in terms of its angular relationship with the ball and in terms of its speed causing the ball to travel slowly or quickly in a straight line or in an arcing trajectory depending on the setting. A pin setting assembly is comprised of a pair of plates one of which is slidable. The non moving plate contains a series of short tubes integral to the bottom and holes at the center of each tube. The pins are set by inserting them into the tubes. The slidable plate is located above the non moving plate and contains a plurality of magnets which correspond to the center of each tubular holder. Ferrous metal elements are molded into the top of each pin allowing the pins to remain suspended above the alley. The plate assembly is pushed down so that the pins touch the alley. The top sliding plate is moved so that the magnets loose contact with the pins allowing them to remain set on the alley.

4 Claims, 11 Drawing Sheets

Fig. 6

BOWLING TOY

BACKGROUND OF THE INVENTION

The present invention relates to a game and more specifically to a toy bowling game. Bowling has been a favorite pastime in the united states and other countries for many years. The game is typically played on a bowling alley which is about 100 feet long using a bowling ball having holes for three fingers by which the bowler grasps the ball and with a swinging arm motion, propels the ball down the alley where it then strikes some or all of the ten bowling pins-located at the far end of the alley. The position of the bowlers hand and the way in which the bowler rotates his or her hand prior to the release of the ball can effect the trajectory of the ball, causing it to roll straight or to go in an arcing curved pattern. After the first attempt to knock down the pins, a mechanism above the pins lifts the remaining standing pins up and the pins which have been knocked down are then automatically swept clear of the alley. The remaining pins are lowered and the bowler then makes a second attempt to knock down the remaining pins. After the second attempt, the pin setting mechanism sweeps clear the remaining pins and resets ten pins for the next player. Numerous toy bowling games have been developed which attempt to simulate the game of bowling on a small scale for home entertainment. However, non of the games attempts to simulate rolling the ball in such a manner as to produce an arcing trajectory as is produced by a real bowler as described above. Additionally non of the prior art has developed a pin setting mechanism which is easy and economical to produce and which leaves the pins unencumbered by magnetic attractions, strings, hinges or other linkages after the pins have been set. When pins are unencumbered by strings, magnets, hinges or any other form of linkage, the resulting action of the bail hitting the pins is altered from the action that normally occurs at a real bowling alley.

SUMMARY OF THE INVENTION

It is an object of the present invention to produce a toy bowling game in which the miniature bowling ball can be propelled in a controllable way with regard to speed, direction and degree of arc as the bail moves from the beginning of a miniature bowling alley to the end of the alley where the pins are located. It is a further object of the present invention to produce a pin setting mechanism which is easy and economical to manufacture and which does not in any way interfere with the pins after the pins are set. To this end the present invention incorporates a tubular member in which the bowling bail is placed. A motorized spinning rubber wheel makes temporary contact with the ball as it rolls down the tube. The speed and orientation of the spinning friction wheel can cause the ball to be propelled in a straight direction or in various degrees of arc depending on what angle the bowler sets the orientation of the spinning friction wheel with respect to the ball as it passes under the wheel. Also, in the present invention, each pin has a small piece of ferrous material embedded in the top most portion of the pin. A series of magnets and cup shapes hold the pins in their proper place as the bowler resets the pins. The bowler then flips the pin holding device over and presses down on the plate holding the pins causing the pins to touch the alley. At this point the pin setting person slides a second plate which dislodges the pins from their magnetic holders thereby leaving them unencumbered as the bowler gets ready to bowl his or her next ball. These and other unique embodiments of the invention will be revealed in the subsequent descriptions and drawings.

DETAILED DESCRIPTION OF THE DRAWINGS

Figure 1:
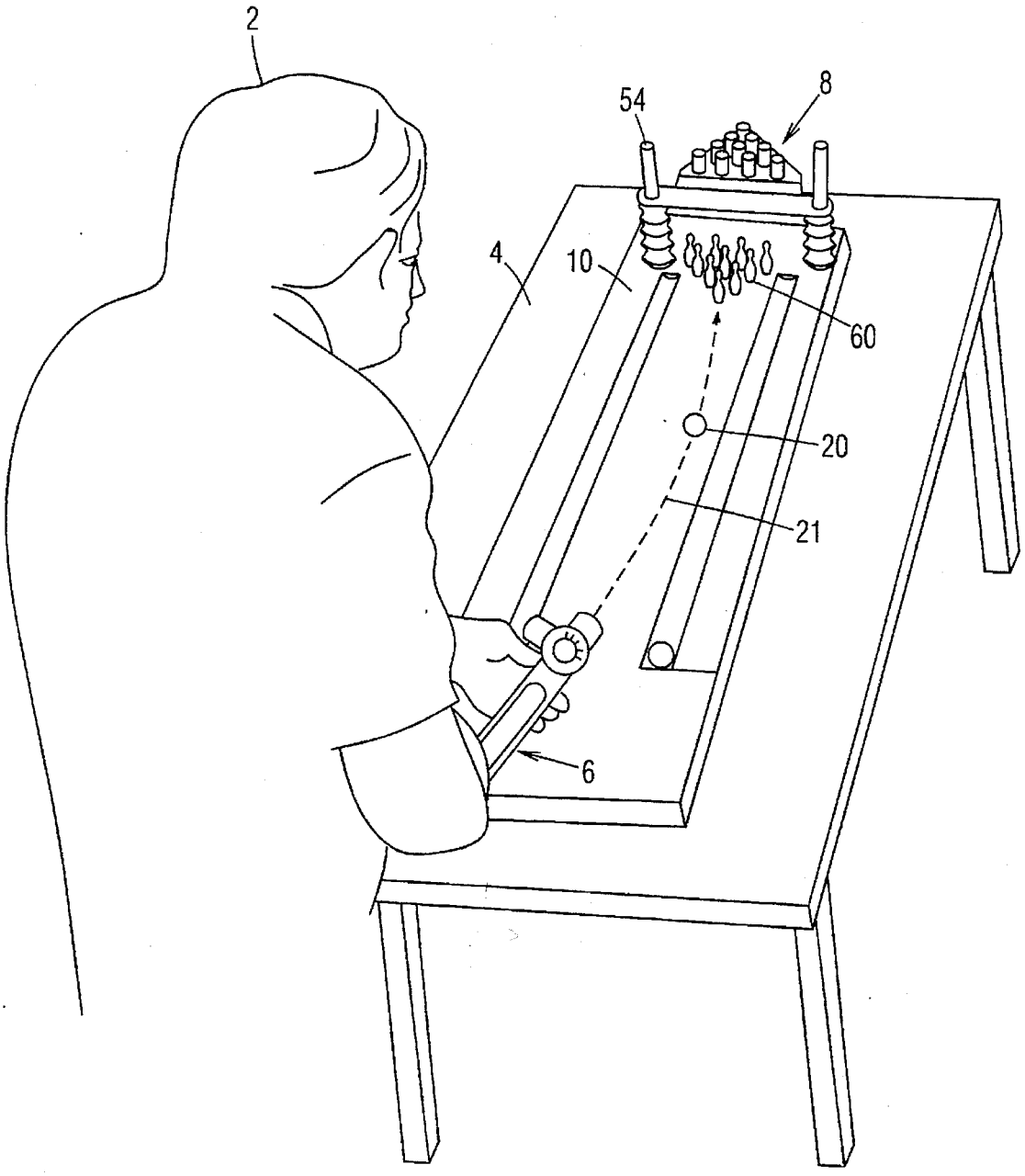
FIG. 1 is a perspective view of a person using the bowling toy of the present invention.

Referring now to FIG. 1, the present bowling toy invention is shown on a table 4. A user 2 has just released a ball 20 from the ball launcher assembly 6 and the ball 20 is progressing in an arced path 21 and will strike bowling pins 60. Pin setting assembly 8 is mounted on two posts 54 located at the end of alley 10.

Figure 2:
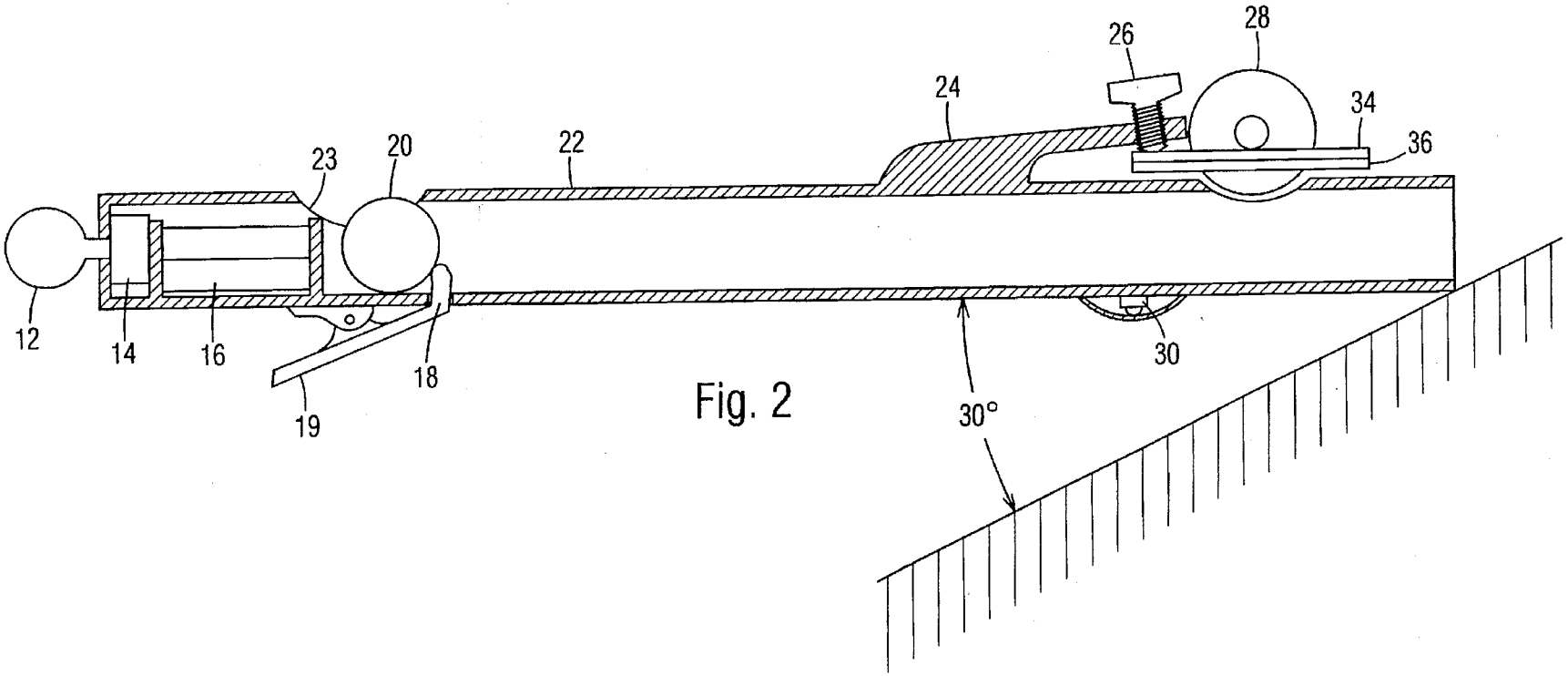
FIG. 2 is a section view of the ball launcher of the bowling toy of the present invention.

FIG. 2 shows a section view of the ball launching assembly 6 of the present invention. The front tip of tube 22 is resting on bowling alley 10 thereby allowing gravity to propel ball 20 down tube 22. The greater the angle 300 the greater the velocity of ball 20. To load ball 20 into the ball launching assembly 6 ball 20 is dropped into hole 23 and is retained by spring pin assembly 18. When a user presses on lever 19, pin 18 is pulled down thereby releasing ball 20 when tube 22 is tilted in a downward position. Rubber Wheel 28 spins by means of a small motor 42. When momentary switch 30 is depressed by the user it causes wheel 28 to spin. The motor and attached wheel 28 are powered by batteries 16 mounted inside tube 22. Knob 12 is attached to potentiometer 14 which when turned controls the revolutions per minute of wheel 28. Knob 26 can be mined by the user to depress flat rings 34 and 36 and associated motor 42 and wheel 28 which in turn causes more frictional interaction between ball 20 and wheel 28 thereby causing ball 28 to be propelled more forcefully down the alley 10.

Figure 3:
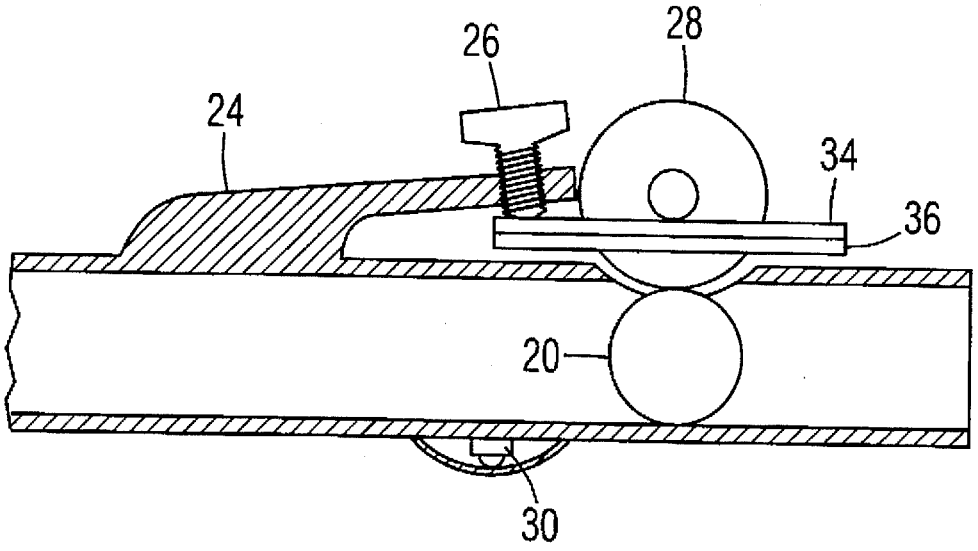
FIG. 3 is a section view of a ball passing through the ball launcher of the bowling toy of the present invention.

FIG. 3 shows ball 20 as it passes under and makes contact with spinning wheel 28.

Figure 4:
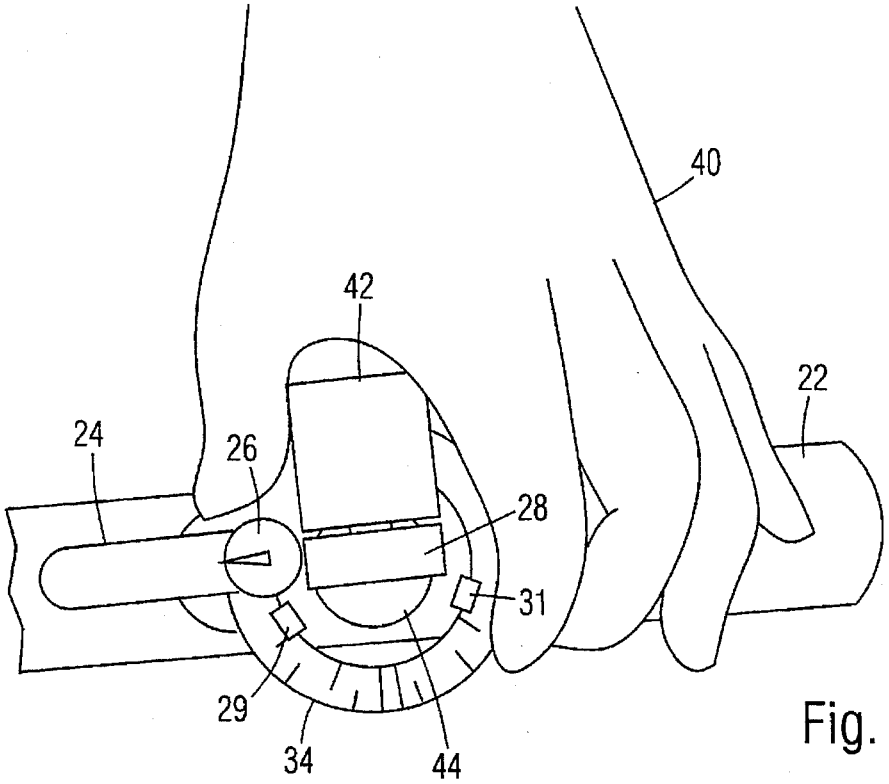
FIG. 4 is a top view of the ball launcher of the present invention being set for a straight trajectory.
Figure 5:
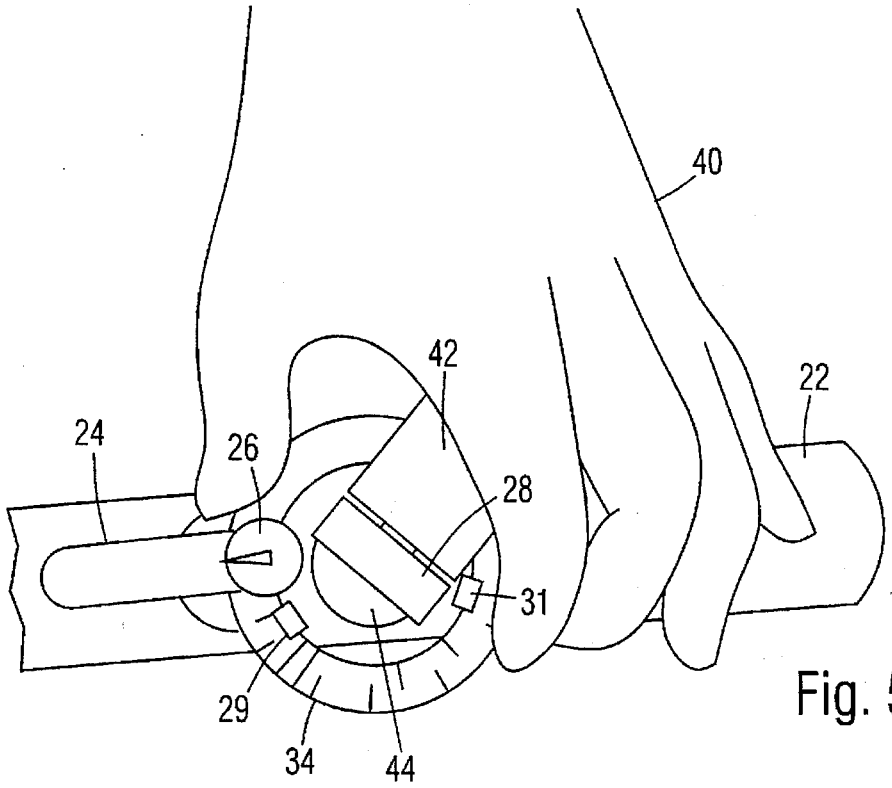
FIG. 5 is a top view of the ball launcher of the present invention being set for a curved trajectory.

FIGS. 4 and 5 show a top view of ball launching assembly 6. FIG. 4 shows the motor 42 and wheel 28 oriented in a position parallel to tube 22 thereby causing ball 20 to be propelled straight ahead motor 42 is mounted to ring 34 which is turnable and held in place by retaining brackets 29 and 31. Ring 34 has a marker 44 on it which corresponds to marks on lower stationary ring 36 allowing the user to calibrate the angle setting he or she has chosen. When the users hand 40 turns ring 34 the user alters the angle of the spinning wheel 28 so that when ball 20 passes under the wheel 28 it is caused to rotate in the plane of the wheel while continuing on the path set by rolling down tube 22. The combined action of the rolling motion and the spinning motion of the ball 20 cause the ball 20 to be propelled down the alley 10 in an arcing trajectory 21 as shown in FIG. 1. By using all the adjustments in the ball launching assembly 6 as described above, the user can choose the angle at which the tube 22 interacts with alley 10, the speed and angle at which wheel 28 spins and propels ball 20, and the mount of contact wheel 28 has with ball 20. With skill, the user can propel the ball 20 down the alley 10 so that it will hit the pins 60 at the proper spot and with the proper speed and spin to knock all the pins down as in a real bowling alley game.

Figure 6:
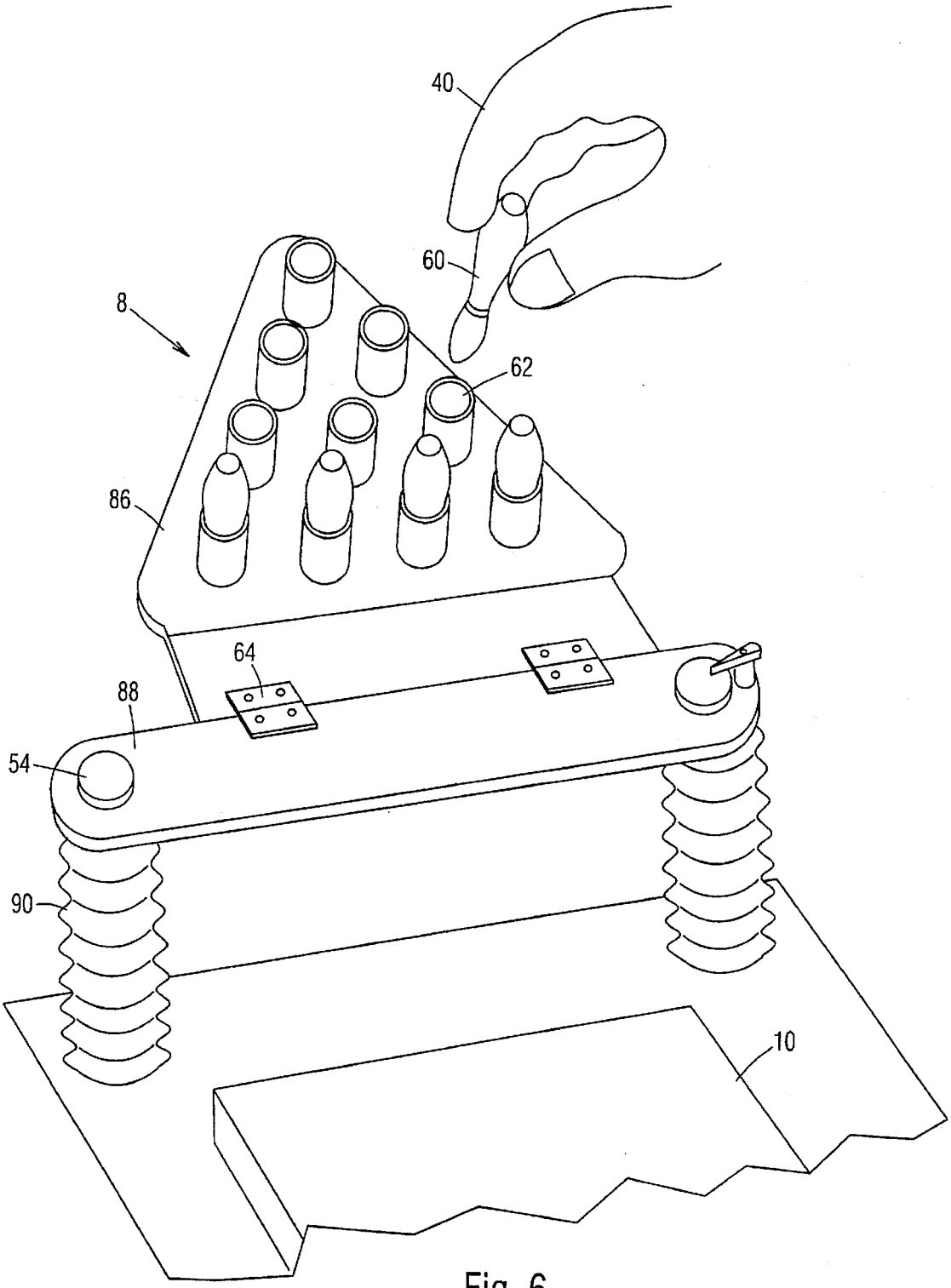
FIG. 6 is a perspective view of a person setting bowling pins in the bowling toy of the present invention.

Referring now to FIG. 6, the user 40 is loading pins into pin setting assembly 8. Plate 84 is swung back via hinges 64 so that insertion of the pins is easy. Tubes 62 help hold pins 60 in place.

Figure 7:
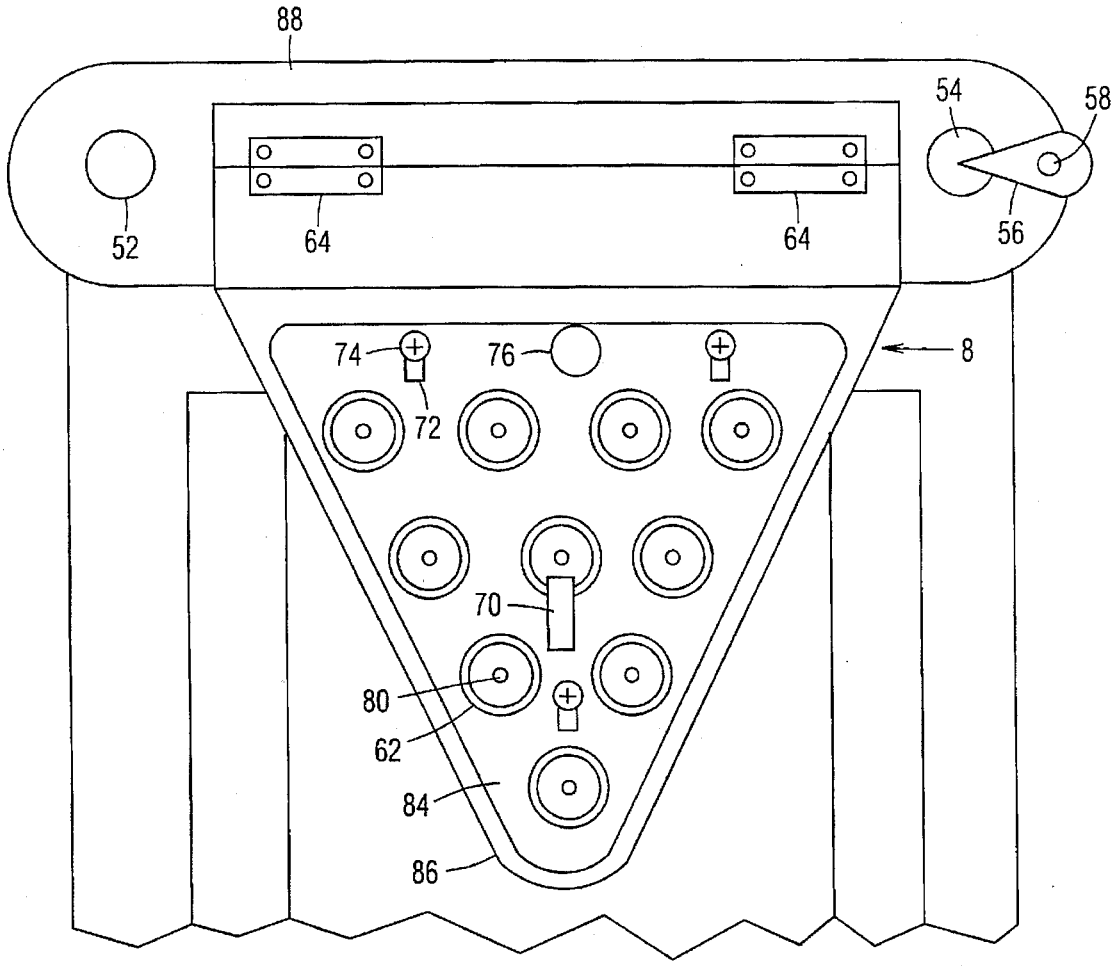
FIG. 7 is a top view of the pin setting assembly of the present invention.

FIG. 7 shows a top view of pin setting assembly 8. Plate 84 is slidable on swingable plate 86. Spring 70 holds plate 84 in a forward orientation. Slots 72 retain posts 74 so that plate 84 slides back in a controlled and limited fashion. Small circles 80 are magnets which are mounted into slidable plate 84. Cross plate 88 rides up and down on posts 52. Arm 56 swings on post 58 and holds cross plate 88 and attached pin setting assembly 8 in the up position.

Figure 8:
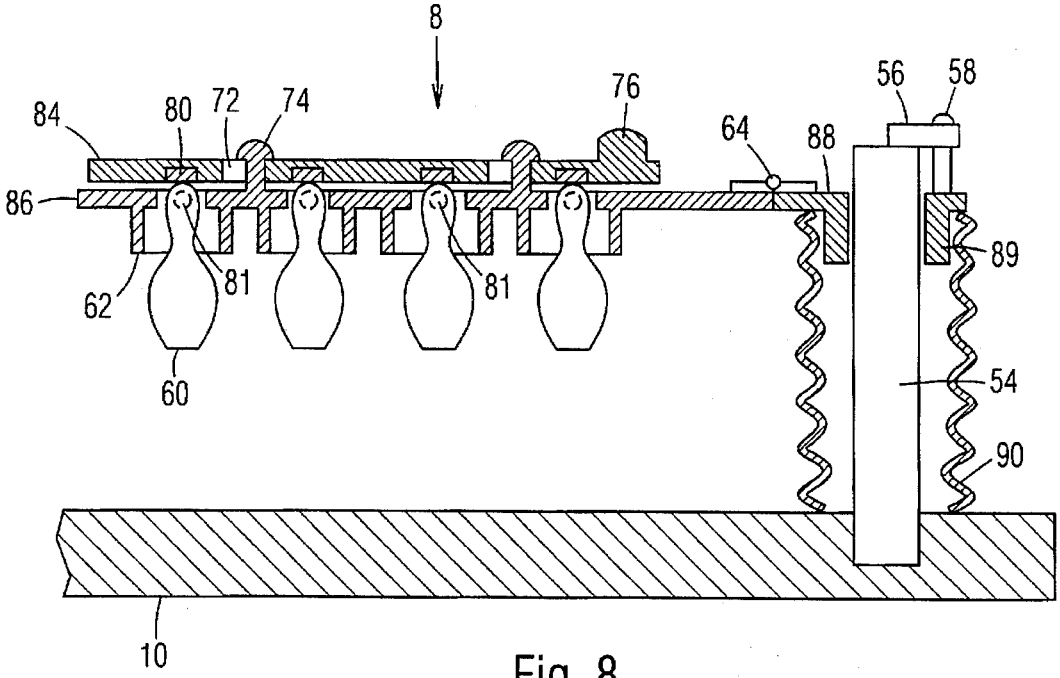
FIG. 8 is a side section view of the pin setting assembly of the present invention.

FIG. 8 shows a side view of the pin setting assembly 8 in the up position. Each pin 60 has a ferrous metal ball embedded in its upper most tip 81. These metal balls make contact with magnets 80 embedded in movable plate 84. In this way pins 60 are held suspended above alley 10. Cross plate 88 can be slid up and down by the user. This action is facilitated by integral bushings 89.

Figure 9:
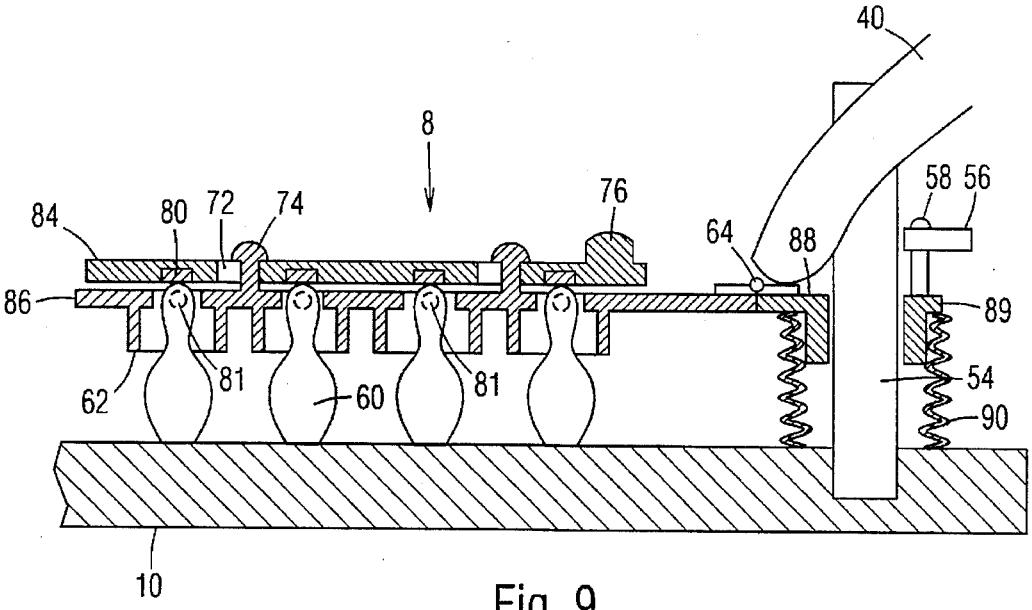
FIG. 9 is a side section view of the pin setting assembly when the assembly is pressed down.

FIG. 9 shows a user pushing down on the pin setting assembly so that the pins 60 touch alley 10. Note that arm 56 is swung in an outward fashion to allow bushing 89 to lower. Bellows 90 are compressed and provide a spring action so that when the user 40 removes his or her finger the cross plate rises.

Figure 10:
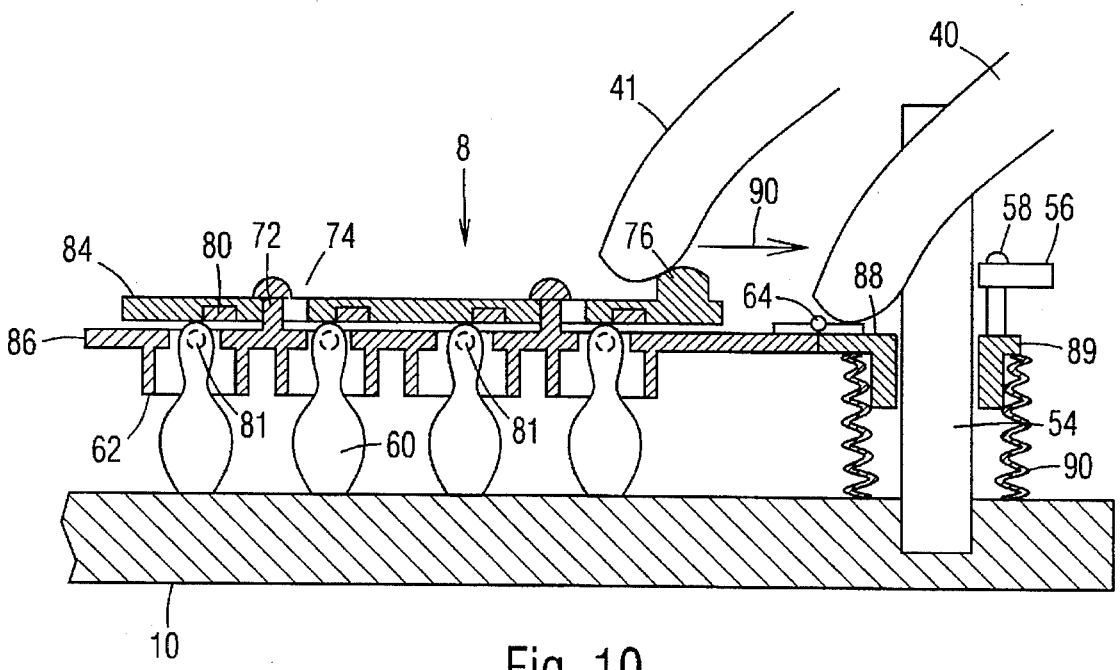
FIG. 10 is a side section view of the pin setting assembly of the present invention when the user is releasing the pins from the assembly.

FIG. 10 shows the user pulling back on a tab 76 located on plate 84 causing the magnets 80 to slide away from embedded metal balls 81 thereby releasing the pins from the pin setting assembly 8.

Figure 11:
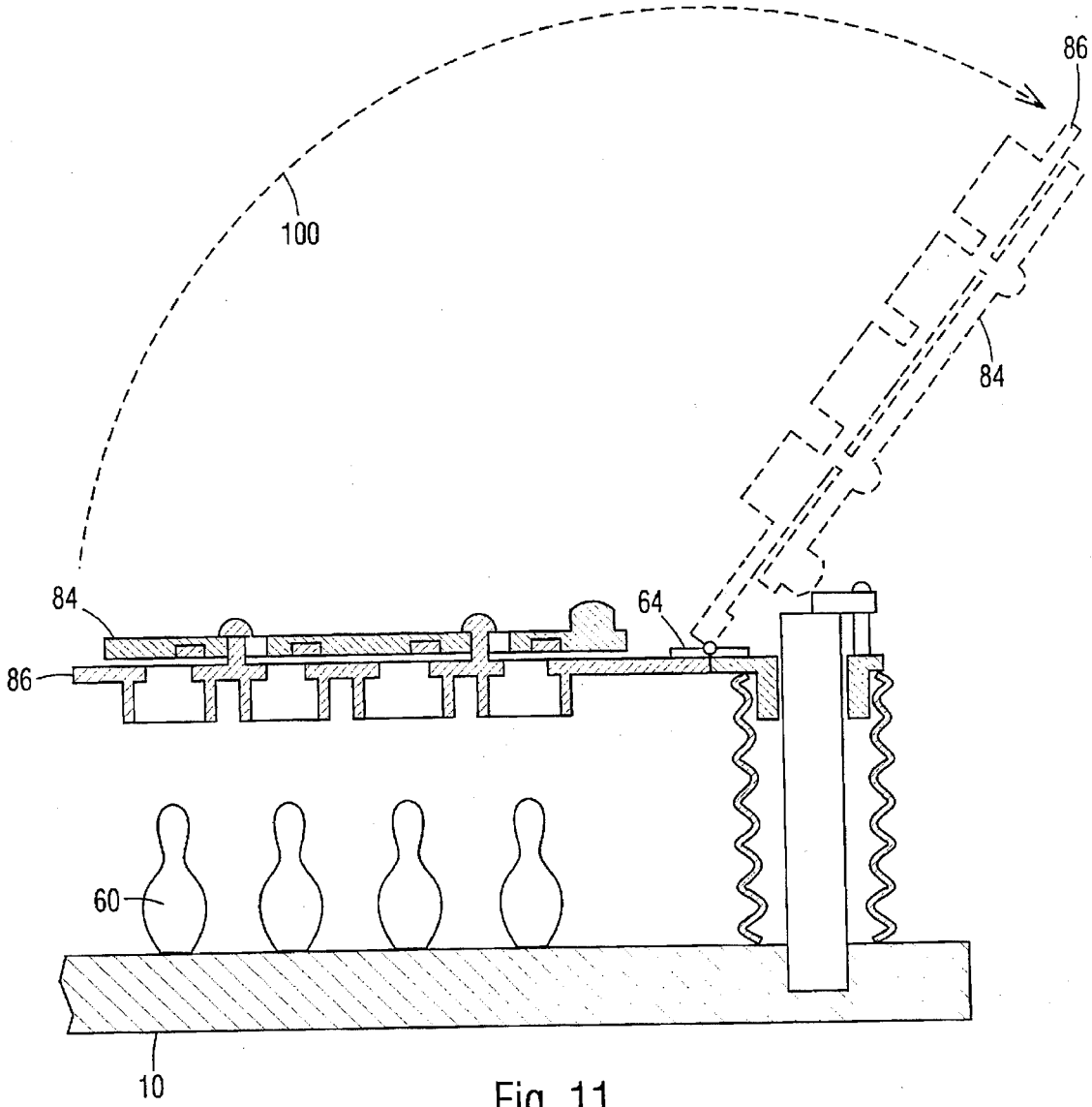
FIG. 11 is a side view of the pin setting portion of the present invention after the pins have been set.

FIG. 11 shows pins 60 in their set position. Plates 86 and 84 can be swung away 100 about hinge 64 for better visibility during bowling and for resetting pins after they have been knocked down. The above described pin setting assembly 8 makes it quick and easy to reset pins 60 thereby enhancing the enjoyment of the bowling toy game of the present invention.

Figure 12:
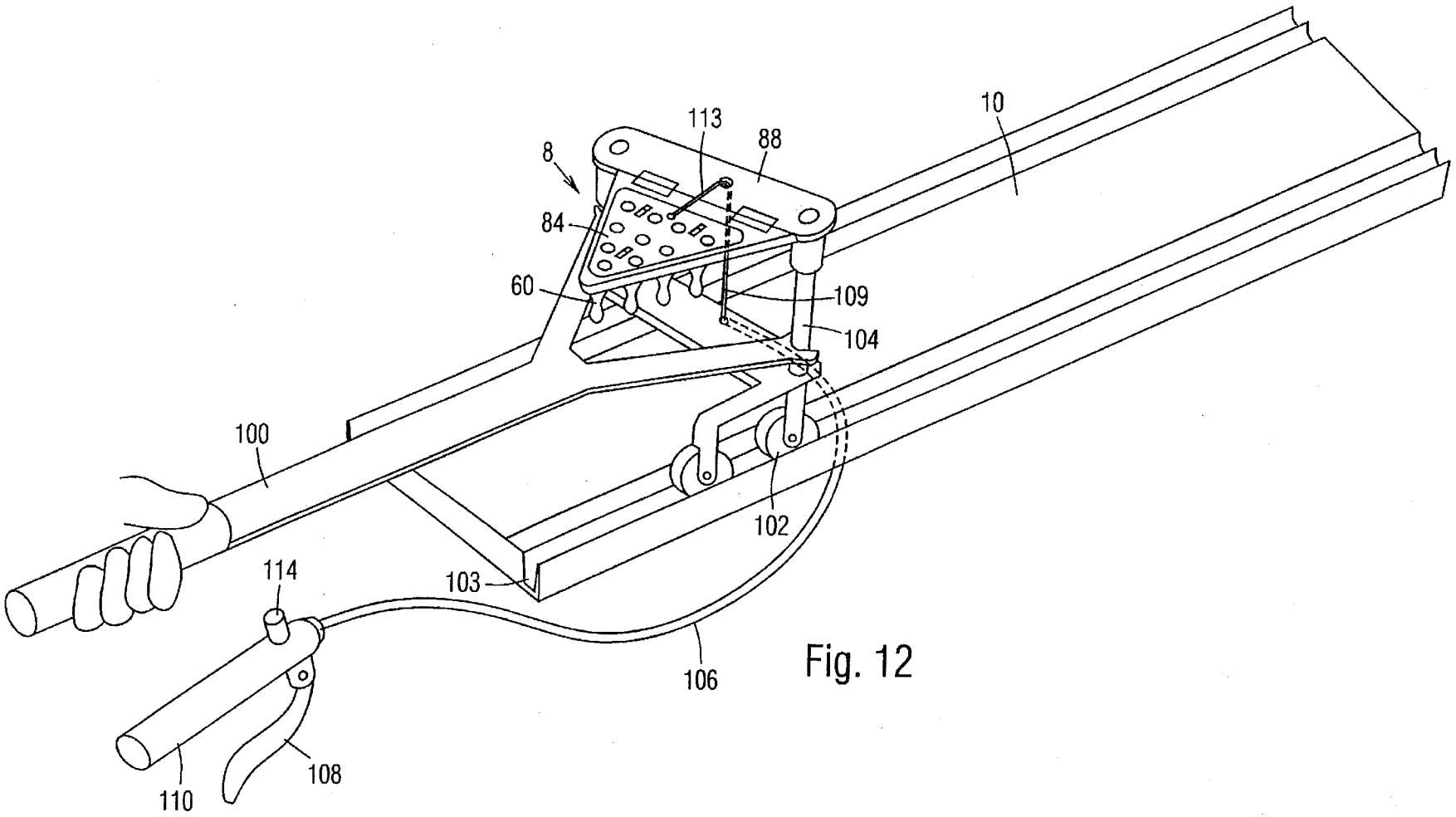
FIG. 12 is a perspective view of an alternate embodiment of the present invention.

More sophisticated models of the above described game can be made where the pin setting assembly 8 can be mounted on rollers as shown in an alternate embodiment in FIG. 12. In this embodiment the user can reset the pins 60 by sliding the pin setting assembly 8 to the front portion of the alley 10 where the bowler is normally found. Push/pull stick 100 locks onto upright poles 104 and the pin setting assembly is brought within reach of the bowler with out the bowler's need to move. Rollers 102 roll in track 103. Cable 109 connects on one end to cross plate and at the other end to lever 108. By squeezing lever 108 the user causes the pin setting assembly to be pulled downward allowing the pins 60 to touch the alley 10. A second cable 109 connects at one end to slide plate 84 and on the other end to push button 114. Pushing on button 114 causes slide plate 84 to slide back thereby releasing the magnetic attraction to the pins 60. In this way the entire pin setting activity can be accomplished by the bowler while remaining in the normal bowling position.

Even more sophisticated arrangements could be designed in which the entire pin setting action were automatic as in a real bowling alley. However, the cost of such a mechanism would make the subsequent bowling toy prohibitively expensive to all but the wealthiest of individuals. Although the above description portrays one embodiment and one alternate embodiment of the present bowling toy invention it should be obvious to those versed in the state of the art that there are other embodiments which would be considered in the spirit of the present invention heretofore described and therefore protected by this patent.

We claim:

1. A bowling toy, comprising:

a miniature bowling alley;

a pin setting assembly comprised of a pair of upright posts located at a bowling pin end of said bowling alley, a cross brace having an integrated pair of open ended bushings penetrated by said upright posts, a pair of hinge members connecting a transverse edge of said cross brace to a swingable plate, said swingable plate having a plurality of tubular members arranged in a pattern of a bowling pin arrangement, said swingable plate having a plurality of holes at a center of each said tubular member, a second slidable plate generally coextensive to said swingable plate mounted directly above said swingable plate, said second slidable plate having a plurality of magnets located directly above said holes in said swingable plate; and a plurality of miniature bowling pins, each said bowling pin having a ferrous metallic component embedded in a top most portion thereof, said ferrous metallic component making contact with said magnets so as to suspend said bowling pins above said alley, said bowling pins being released when said slidable plate is moved to one side thereby causing a loss of magnetic attraction; and a ball launching mechanism comprised of a tubular member having a hole at a distal end receiving a miniature bowling ball, a retractable ball retaining pin arranged on said tubular member near a proximal end for selectably retaining and releasing said bowling ball, an opening on a side of said tubular member near said distal end, a rotatable ring circumscribing said opening, a motor and attached rubber wheel mounted perpendicularly to said rotatable ring, a power source powering said motor, a potentiometer connected to said motor for controlling a speed of said motor, a knob attached to said potentiometer for adjusting said potentiometer, and a momentary switch connected to said motor for activating said motor and attached rubber wheel, said rubber wheel penetrating said opening and engaging said miniature bowling ball as said bowling ball passes under said rubber wheel so as to propel said bowling ball toward said bowling pins.

2. The bowling toy of claim 1, wherein said cross brace is supported by a pair of spring members located around said upright posts, said cross brace being held aloft when desired by a swingable arm mounted to a post located to a side of one of said upright posts.

3. The bowling toy of claim 1, wherein said pin setting assembly is mounted on rollers located in tracks on either side of said bowling alley, said pin setting assembly being able to be rolled forward so that a user can reset said pins without changing positions.

4. The bowling toy of claim 1, further including means attached to said pin setting assembly for remotely operating said pin setting assembly.

* * * * *